United States Patent [19]

Anderson

[11] Patent Number: 5,012,068

[45] Date of Patent: Apr. 30, 1991

[54] SUSCEPTOR FOR CONVERTING MICROWAVE ENERGY INTO HEAT AND METHOD OF USE

[76] Inventor: Alan R. Anderson, 707 Pheasant Run, West Chester, Pa. 19382

[21] Appl. No.: 436,729

[22] Filed: Nov. 15, 1989

[51] Int. Cl.[5] ..... H05B 6/80

[52] U.S. Cl. ..... 219/10.55 M; 219/10.55 E; 219/10.55 F; 426/107; 426/234; 426/243; 99/DIG. 14

[58] Field of Search ..... 219/10.55 E, 10.55 F, 219/10.55 M, 10.55 R; 426/107, 109, 110, 113, 234, 241, 243; 99/DIG. 14, 451; 126/390

[56] References Cited

U.S. PATENT DOCUMENTS

| | | | |
|---|---|---|---|
| 3,973,045 | 8/1976 | Brandberg et al. | 426/110 |
| 4,038,425 | 7/1977 | Brandberg et al. | 426/107 |
| 4,190,757 | 2/1980 | Turpin et al. | 219/10.55 E |
| 4,219,573 | 8/1980 | Borek | 219/10.55 E |
| 4,292,332 | 9/1981 | McHam | 426/111 |
| 4,450,180 | 5/1984 | Watkins | 426/107 |
| 4,461,031 | 7/1984 | Blamer | 426/113 |
| 4,503,559 | 3/1985 | Warnke | 383/40 |
| 4,548,826 | 10/1985 | Watkins | 426/394 |
| 4,553,010 | 11/1985 | Bohrer et al. | 219/10.55 E |
| 4,563,561 | 1/1986 | Vaeth et al. | 219/10.55 E |
| 4,571,337 | 2/1986 | Cage et al. | 426/107 |
| 4,584,202 | 4/1986 | Roccaforte | 426/111 |
| 4,592,914 | 6/1986 | Kuchenbecker | 426/107 |
| 4,640,838 | 2/1987 | Isakson et al. | 426/107 |
| 4,678,882 | 7/1987 | Bohrer et al. | 219/10.55 E |
| 4,735,513 | 4/1988 | Watkins et al. | 219/10.55 E |
| 4,748,308 | 5/1988 | Drews | 219/10.55 E |
| 4,794,005 | 12/1988 | Swiontek | 219/10.55 E |
| 4,810,844 | 3/1989 | Anderson | 219/10.55 E |
| 4,864,090 | 9/1989 | Maxwell et al. | 219/10.55 E |

*Primary Examiner*—Philip H. Leung
*Attorney, Agent, or Firm*—Ratner & Prestia

[57] ABSTRACT

A method for cooking in a microwave oven is provided, in which edible ingredients are combined in a container transparent to microwave energy. A cooking optimizer panel having two faces of differing susceptibility to microwave energy is placed underneath the food container in a configuration determined by the power of the microwave oven.

32 Claims, 1 Drawing Sheet

SUSCEPTOR FOR CONVERTING MICROWAVE ENERGY INTO HEAT AND METHOD OF USE

BACKGROUND OF THE INVENTION

1. Field of the Invention

This invention provides an improved method for the preparation of food, particularly popcorn, in a microwave oven.

2. Description of Related Art

The development of microwave cooking has had an enormous impact on commercial, industrial and home food preparation. The high speed with which cooking occurs, and the broad array of materials suitable for use in microwave ovens have engendered a large number of new uses for microwave ovens. One such use is the preparation of low density snack items, such as by the popping of kernels of corn.

Popping of popcorn in a microwave oven has presented problems, typical of which is the low percentage of popcorn popped. The art is replete with examples of ingenious approaches to reducing the number of "old maids," thereby maximizing the yield of popped corn.

U.S. Pat. No. 3,973,045—Brandberg et al. discloses a corn container made from a compact gusseted paper bag. Unfortunately, this construction still leaves up to 25% of the corn kernels unpopped, and 5% burned after exposure for approximately 2½ minutes to microwave energy.

A number of solutions involving more efficient use of heat have been proposed to reduce the percentage of corn kernels left unpopped. U.S. Pat. No. 4,038,425—Brandberg et al. discloses a dual-compartmented container. The first compartment is small and contains a charge of popcorn; the second compartment is larger, and provided with pleats, folds or gussets to enable it to expand to hold the popped kernels.

U.S. Pat. No. 4,156,806—Teich et al. and U.S. Pat. No. 4,335,291—Ishino et al. disclose the use of containers for concentrating microwave energy at the base of a conically shaped bowl for the purpose of improving efficiency and speed of popping. One embodiment disclosed by Teich uses a microwave lossy, powdered or particulate material at the base area. The lossy material itself heats up and radiates heat to the kernels located close to it, thereby adding to the heat induced in the kernels. The use of microwave lossy material is a widely known concept in microwave food preparation containers.

U.S. Pat. No. 4,553,010—Bohrer et al. discloses a package for shipping and microwave popping of popcorn having a microwave interactive material integrally attached to the bottom panel of an expandable bag containing popcorn.

In an effort to solve the related problem of excessive heat transfer to the popcorn, U.S. Pat. No. 4,219,573—Borek discloses an expandable popcorn package having an integrated insulating member on the bottom of the package.

The prior art approaches to maximizing the yield of popcorn while minimizing or avoiding burning of the popcorn or the bag, therefore, have relied upon provision of fully integrated containers in which either a thermal insulator or a microwave interactive material is permanently affixed to the bag material. These bags are generally prepared from Kraft paper, and as a result of the inclusion of the microwave interactive material, are both expensive and non-transparent.

U.S. Pat. No. 4,810,844—Anderson discloses a highly efficient microwave popcorn package utilizing a bag having an inwardly pleated bottom panel. The configuration of this bag contrasts favorably to the traditional flat-bottom and side-gusseted bag in which most microwave popcorn is sold at this time. In addition, better popping efficiency is obtained because the popcorn kernels are massed together, rather than spread out. Hence, the greater mass is capable of more efficiently conducting microwave energy. At the same time, by virtue of the unique construction of the bag, the upper opening of the bag through which the edible popcorn ingredients are placed during the packaging process, and through which the popcorn is served after cooking, is quite large, making the packaging and serving processes much more convenient.

A further advantage of the Anderson bag is that it may be prepared from a visible light transparent material. This allows the consumer to watch the corn inside being popped, cutting down on the chances of under- or overcooking the popcorn as well, not to mention the significant entertainment value.

Since the Anderson bag can be made from relatively thin film, the costs of the bag and of the associated final product are, therefore, significantly less than those of current commercial popcorn containers.

However, although the Anderson bag provides the aforementioned advantages, it is still desirable to further increase the yield of the popcorn while maintaining the elegant simplicity of the Anderson bag and serving container.

It is an object of this invention then to provide a method for the popping of corn in a low-cost package with a volume equivalent to that of prior art packages without the necessity for the complex construction of the prior art packages.

It is a further object of this invention to provide an improved method for the preparation of low density food items, or of light loads, in a microwave oven.

SUMMARY OF THE INVENTION

A method for cooking food items, including popcorn, in a microwave oven is provided, in which edible ingredients are combined in a container transparent to microwave energy. A cooking optimizer panel having two faces of different susceptibility to microwave energy is placed underneath the container in a configuration determined by the power of the microwave oven. In a high power oven, the cooking optimizer panel is placed on the oven floor with its more insulated face in contact with the food; in a low power oven, the cooking optimizer panel is positioned with the higher susceptibility face in contact with the food.

DETAILED DESCRIPTION OF THE INVENTION

Home microwave ovens are generally available in two sizes, referred to herein as low wattage and high wattage. Low wattage ovens range in power from around 450 to 500 watts; the high wattage ovens from around 600 to 700 watts. Due to the significant difference in the power output of these ovens, the results of cooking in either one will vary significantly.

In this invention, the power output of the microwave oven is first determined, either by consulting the manufacturer's literature or by a simple test of determining the length of time in which water will boil when placed in the microwave oven. If a cup of water requires longer than 3 minutes to boil, the oven is considered low power. Knowing the power of the microwave oven, the cooking optimizer panel of the invention can then be located in the preferred configuration.

Figure 1:
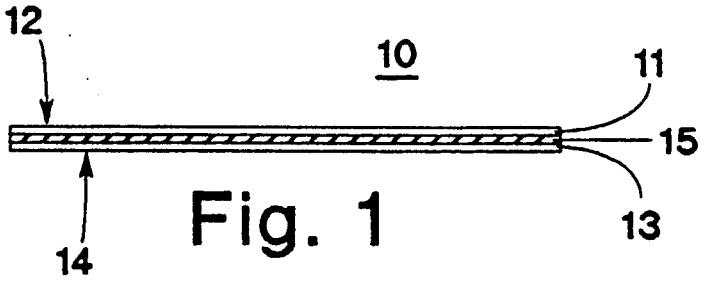
FIG. 1 is a cross-sectional view of a susceptor panel of the present invention.

Referring now to FIG. 1, the objectives of this invention are achieved by the provision of a cooking optimizer panel 10 having two opposing faces 12 and 14 of different susceptibility to microwave energy. The higher susceptibility, or more lossy, face 12 will absorb more energy and transfer more heat to the items being cooked. This is desirable in a low power oven. Conversely, in a high power oven, the lower susceptibility, or more insulating face, 14 of the panel is placed in contact with the food item to reduce thermal transfer. In this way, a single cooking panel is therefor useful in either high or low power ovens. In one embodiment, the cooking optimizer panel is substantially flat. Alternatively, the panel has raised edges, allowing the panel to be used as a platform or as a box. Optionally, the edges are also made of microwave interactive material.

Of particular utility to the packager is that food may be packed in lower cost, more convenient containers and simply enclosed with the cooking optimizer panel in the final retail package. An alternative packaging approach makes the cooking optimizer panel an integrated part of the retail package into which the container of food items is inserted. The container of food items can be shipped and sold in the package with the built-in panel, removed from the package, and then cooked using the package panel.

Figure 2:
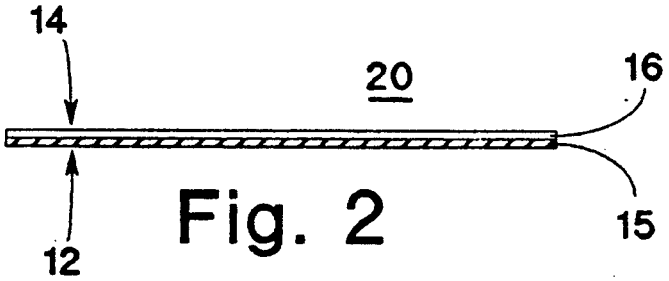
FIG. 2 is a cross-sectional view of a susceptor panel of the present invention.

Referring now to FIG. 2, in one embodiment, the cooking optimizer panel 20 has microwave interactive material 15 on one side only of a cardboard or Kraft paper sheet 16. A typical panel, is composed of a vacuum-metallized aluminum grid 15 on a polyester (not shown) which, in turn, is laminated to cardboard 16. Alternatively, a thin metallic film may be employed. The desired position of this panel in use would be with the metallized face up for the low wattage oven, and the metallized face down for the high wattage oven. It has been found that a grid pattern of metallized aluminum on polyester having an optical density of about 0.020 versus uncoated polyester (about 75% coverage of the surface) is preferred for the practice of this invention as applied to popcorn. Alternatively, as shown in FIG. 1, the microwave interactive material, or susceptor 15, is sandwiched between two sheets 11 and 13 of different insulating values, such as 30 lb and 80 lb paper. This construction also provides the desired differential susceptibility and thermal transfer. Selecting the most desirable differential in susceptibility from one face to the other is a matter of routine experimentation and will depend upon the nature of the food item and the overall package configuration.

Microwave interactive materials suitable for use in this invention include aluminum, stainless steel, and the like, such as are disclosed in U.S. Pat. No. 4,190,757—Terpin et al.; U.S. Pat. No. 3,783,220—Tanizaki; U.S. Pat. No. 4,290,924—Brasatd et al.; and U.S. Pat. No. 4,283,427—Winters et al. The disclosures of the foregoing patents are incorporated by reference herein.

In a low wattage oven, the higher susceptibility or metallized side of the panel is placed face-up in contact with the bag containing the edible ingredients. In a high wattage oven, the package is placed on top of the lower susceptibility or more highly insulated side of the panel, so as to reduce the amount of energy which is transferred to the food, thereby providing high yield without damage or burn-through of the package.

Figure 3:
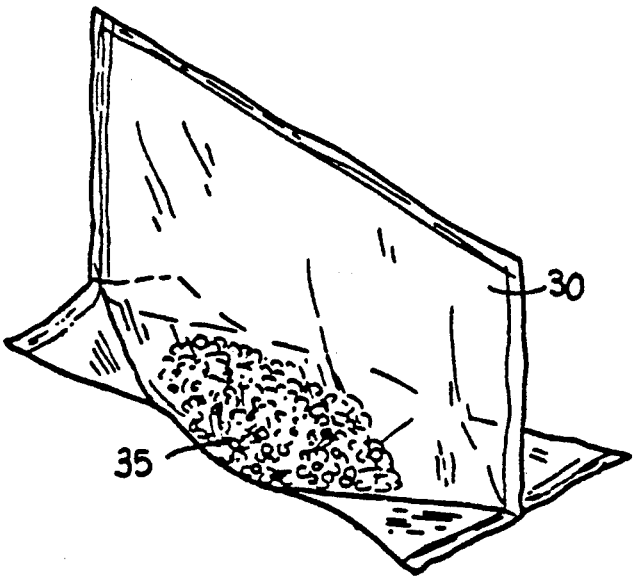
FIG. 3 is a perspective view of a popcorn package according to the present invention.

As shown in FIG. 3, and as previously indicated, a container or bag 30 holding edible ingredients 35 may be prepared from a transparent material, however, non-transparent material, such as paper, may also be utilized. The material from which the container is formed must be substantially transparent to microwave energy, and able to withstand the temperatures reached during microwave cooking. The material from which the container is made is also preferably impervious to any cooking oils or fats packaged with the food item. Suitable materials include films of polyesters, polycarbonates and nylon. A preferred film is polyethylene terephthalate film coated on one side with a copolyester or other material, such as polyvinyl alcohol, that allows for heat sealing. From a packaging standpoint, it is advantageous if the material from which the container is made has sufficiently low water and vapor permeability to allow for a long shelf-life of the packaged ingredients. If the container is not made from such a barrier material, as, for example, a paper bag, it may be overwrapped with a barrier material, such as a polyester film, to provide barrier protection. The overwrap is removed by the consumer prior to placing the microwave package in the oven.

Preferably, the package of this invention is a 0.5 mil polyester bag made in the pleated arrangement disclosed in U.S. Pat. No. 4,810,844—Anderson, the disclosure of which is incorporated by reference herein. A typical bag 30, according to this invention is shown in FIG. 3. The bag 30 may have side panels measuring 7×12 inches, a bottom panel measuring 4×12 inches, corners of the bottom panel being joined to corners of the side panel so that the inside surface area of the bottom panel measures approximately 32 square inches (versus 48 square inches for the outside surface of the bottom panel). A bag of the size described above would preferably be packed to hold about 3 to 4 ounces of edible popcorn ingredients, including unpopped corn, oil and/or butter, salt and optional flavoring ingredients. Edible popcorn ingredients are placed inside the bag which is capable of standing substantially upright with the popcorn ingredients resting on the bottom.

In use, the bag is placed on top of the cooking optimizer panel in the configuration which will lead to the optimum results. In the practice of this invention, the popping optimizer panel is placed in the desired configuration on the floor of the microwave oven, the bag containing the edible popcorn ingredients is placed on top of it, and the popping process is begun. It has been found that yields equivalent to that obtainable with prior art containers are obtained, and that there is no burn-through of the thin polyester bag during the popping process.

Among the many advantages of this invention are that the food item can be packaged directly in a low-cost bag of practically any configuration, a suitably shaped cooking optimizer panel can be provided along with the bag, and the entire combination provided in a retail container designed for consumer appeal.

Although this invention has been described with particular reference to the cooking of popcorn, it will be appreciated that the cooking optimizer panel will be useful for the microwave cooking of any low density food, or for microwave preparation of light loads, on the order of a half pound or less.

What is claimed is:

1. A process of preparing food in a microwave oven, comprising:

(a) determining the wattage of said oven;

(b) locating a susceptor means for converting microwave energy into heat in said oven, said susceptor means having a microwave interactive material integrally associated therewith; and (c) placing a container of food in the oven directly on top of the susceptor means, said container comprising a material substantially transparent to microwave energy, wherein said susceptor means has two opposing faces of differing susceptibility to microwave energy, a more insulating face and a less insulating face, said susceptor means positioned with its less insulating face in contact with the container in a low power oven and its more insulating face in contact with the container in a high power oven.

2. A process of claim 1 wherein the susceptor means has a microwave interactive material on one face thereof.

3. A process of claim 1 wherein the susceptor means is a laminate of a first microwave insulating material, microwave interactive material, and a second microwave insulating material, wherein said first and second insulating materials are of different insulating power.

4. A process of claim 1 in which the area of the susceptor means is sufficiently large so that substantially all edible ingredients are situated thereon.

5. A process of claim 1 in which the food is a low density food.

6. A process of claim 1 in which the edges of the susceptor means are folded down to avoid charring of the microwave interactive material.

7. A combination for the preparation of food in a microwave oven comprising a container for the food and a susceptor means for use with said container, wherein said susceptor means is situated under said container during cooking, said susceptor means having two faces of differing susceptibility to microwave energy; a first face, adapted to optimize cooking in a low wattage microwave oven, and a second face, adapted to optimize cooking in a high wattage microwave oven, said susceptor means being placed with the first face under and in contact with the container in a low power oven, said susceptor means being placed with the second face under and in contact with the container in a high power oven.

8. A combination of claim 7 in which said container comprises a material which is substantially transparent to visible light.

9. A combination of claim 8 in which said container is a bag of polyester film.

10. A combination of claim 7 in which said container is a paper bag.

11. A combination of claim 7 in which the susceptor means is a light metallized film laminated to paper.

12. A combination of claim 11 where said metal is aluminum.

13. A combination of claim 7 in which said susceptor means is a laminate of a first insulating material, a microwave interactive material and a second insulating material, wherein said first and second insulating materials are of different susceptibility to microwave energy.

14. A process of preparing popcorn in a microwave oven, comprising:

(a) determining the wattage of said oven;

(b) locating a susceptor means for converting microwave energy into heat in said oven, said susceptor means having two faces of different susceptibility to microwave energy, a more insulating face and a less insulating face; and (c) placing a container of edible popcorn ingredients in the oven directly on top of the susceptor means, said container comprising a material substantially transparent to microwave energy, wherein said susceptor means is placed with the higher susceptibility microwave interactive material face in contact with the container of edible ingredients in a low power oven, and with the lower susceptibility face in contact with the container in a high power oven.

15. A process of claim 14 in which the area of the susceptor means is sufficiently large so that substantially all edible popcorn ingredients are situated thereon.

16. A process of claim 14 in which the edges of the susceptor means are folded down to avoid charring of the microwave interactive material.

17. A combination for the preparation of popcorn in a microwave oven comprising a container for edible popcorn ingredients, and a susceptor means for use with said container, wherein said susceptor means is placed under said container while the popcorn is being popped in a configuration determined by the power of the microwave oven, said susceptor means having two faces of differing susceptibility to microwave energy; a first face adapted to optimize popping of said popcorn ingredients in a low wattage microwave oven, and a second face adapted to optimize popping of said popcorn ingredients in a high wattage microwave oven.

18. A combination of claim 17 in which said container comprises a material which is substantially transparent to visible light.

19. A combination of claim 18 in which said container is a polyester bag.

20. A combination of claim 17 in which said container is a paper bag.

21. A combination of claim 17 in which the susceptor means comprises a lightly metallized film laminated to paper.

22. A combination of claim 21 in which the metal is aluminum.

23. A combination of claim 17 in which the susceptor means is a laminate of a first insulating material, a microwave interactive material, and a second insulating material, wherein said first and second insulating materials are of different susceptibility to microwave energy.

24. A process of preparing food in a microwave oven, utilizing a susceptor means for converting microwave energy into heat, said susceptor means including a microwave interactive material integrally associated therewith, and having two opposing faces of differing susceptibility to microwave energy, a more insulating face and a less insulating face, comprising:

(a) selectively positioning said susceptor means on the bottom of the oven with the less insulating face facing upwards in a low power oven and the more insulating face facing upwards in a high power oven; and (b) placing a container of food in the oven directly on top of the susceptor means, said container comprising a material substantially transparent to microwave energy.

25. A process of claim 24 wherein the susceptor means has a microwave interactive material on one face thereof.

26. A process of claim 24 wherein the susceptor means is a laminate of a first insulating material, a microwave interactive material, and a second insulating material, wherein said first and second insulating materials are of different insulating values.

27. A process of claim 24 in which the area of the susceptor means is sufficiently large so that substantially all edible ingredients are situated thereon.

28. A process of claim 24 in which the food is a low density food.

29. A process of claim 24 in which the edges of the susceptor means are folded down to avoid charring of the microwave interactive material.

30. A process of preparing popcorn in a microwave oven, utilizing a susceptor means for converting microwave energy into heat, said susceptor means including a microwave interactive material integrally associated therewith, and having two opposing faces of differing susceptibility to microwave energy, a more insulating face and a less insulating face, comprising:

(a) selectively positioning said susceptor means on the bottom of the oven with the less insulating face facing upwards in a low power oven and the more insulating face facing upwards in a high power oven; and (b) placing a container of edible popcorn ingredients in the oven directly on top of the susceptor means, said container comprising a material substantially transparent to microwave energy.

31. A process of claim 30 in which the area of the susceptor means is sufficiently large so that substantially all edible popcorn ingredients are situated thereon.

32. A process of claim 30 in which the edges of the susceptor means are folded down to avoid charring of the microwave interactive material.

* * * * *